US007364641B2

(12) United States Patent
Chen et al.

(10) Patent No.: US 7,364,641 B2
(45) Date of Patent: Apr. 29, 2008

(54) MANUFACTURE OF PAPER AND PAPER BOARD

(75) Inventors: Gordon Cheng Chen, Chesapeake, VA (US); Stephanie Caine Williams, Suffolk, VA (US); Swindell Allen Grimsley, Chesapeake, VA (US)

(73) Assignee: Ciba Specialty Chemicals Water Treatments Ltd., West Yorkshire (GB)

( * ) Notice: Subject to any disclaimer, the term of this patent is extended or adjusted under 35 U.S.C. 154(b) by 0 days.

(21) Appl. No.: 10/479,942

(22) PCT Filed: Jun. 18, 2002

(86) PCT No.: PCT/EP02/06721

§ 371 (c)(1),
(2), (4) Date: Dec. 4, 2003

(87) PCT Pub. No.: WO03/000985

PCT Pub. Date: Jan. 3, 2003

(65) Prior Publication Data

US 2004/0149407 A1 Aug. 5, 2004

(30) Foreign Application Priority Data

Jun. 25, 2001 (GB) ..... 0115411.1

(51) Int. Cl.
*D21F 11/00* (2006.01)

(52) U.S. Cl. ..... 162/158; 162/181.8; 162/181.2; 162/181.4; 162/181.6; 106/483; 106/491

(58) Field of Classification Search ..... 162/158, 162/181.8, 181.2, 181.4, 181.6; 106/483, 106/491

See application file for complete search history.

(56) References Cited

U.S. PATENT DOCUMENTS

| | | | | |
|---|---|---|---|---|
| 4,792,487 | A | 12/1988 | Schubring et al. | 428/342 |
| 4,913,775 | A | 4/1990 | Langley et al. | 162/164.3 |
| 5,194,120 | A | 3/1993 | Peats et al. | 162/168.3 |
| 5,571,379 | A | 11/1996 | Derrick | 162/168.1 |
| 5,573,658 | A | 11/1996 | Kunkle et al. | 209/164 |
| 5,676,796 | A * | 10/1997 | Cutts | 162/158 |
| 6,372,088 | B1 * | 4/2002 | Laivins et al. | 162/168.1 |

FOREIGN PATENT DOCUMENTS

| | | |
|---|---|---|
| EP | 0235893 | 9/1987 |
| EP | 0373306 | 6/1990 |
| WO | 95/02088 | 1/1995 |
| WO | 98/23815 | 6/1998 |
| WO | 99/14432 | 3/1999 |
| WO | 01/40577 | 6/2001 |

OTHER PUBLICATIONS

H. van Olphen "An Introduction to Clay Colloid Chemistry", 'Wiley Press, 1977.
"Additives for Consumer Care Products" by Southern Clay Products No Date.

* cited by examiner

*Primary Examiner*—Mark Halpern
(74) *Attorney, Agent, or Firm*—Shiela A. Loggins

(57) ABSTRACT

Process for making paper or paper board comprising, forming an aqueous cellulosic suspension, adding a retention system to the cellulosic suspension, draining the suspension on a screen to form a sheet and drying the sheet, wherein the retention system comprises a swelling clay which has a TAPPI brightness of at least 70.

18 Claims, No Drawings

MANUFACTURE OF PAPER AND PAPER BOARD

This application is the national phase under 35 U.S.C. §371 of POT International Application No. PCT/EP00/06721 which has an International filing date of Jun. 18, 2002, which designated the United States of America.

The present invention relates to the production of paper or paper board by a process comprising forming an aqueous cellulosic suspension, adding a retention system to the cellulosic suspension, draining the suspension on a screen to form a sheet and drying the sheet, wherein the retention system comprises a swelling clay. Paper making processes of this type are well documented in the literature and include for instance the Hydrocol (trade mark) process which involves the use of bentonite (i.e. an anionic swelling clay) as part of the retention system. Such processes are described in, for instance, EP-A-235893, U.S. Pat. No. 4,913,775 and EP-A-707673.

EP-A-235893 provides a process wherein a water soluble substantially linear cationic polymer is applied to the paper making stock prior to a shear stage and then reflocculating by introducing bentonite after that shear stage. This process provides enhanced drainage and also good formation and retention. This process which is commercialised by Ciba Specialty Chemicals under the Hydrocol® trade mark has proved successful for more than a decade.

Generally it has been found that paper making systems which employ a swelling clay as part of the retention system provide significant improvements in drainage rate and retention. Typically swelling clays include bentonites, sepiolites and attapulgites etc. Bentonites include a general class of clays known as smectites, which include such clay varieties as montmorillonites, saponites, armargosite, nontronite and hectorite. In many instances retention systems which comprise swelling clays provide much improved drainage and retention, by comparison even with other microparticulate systems, employing for instance colloidal silica and polysilicic acid.

However, a particular drawback of clay based retention systems is that paper produced therefrom tends to suffer diminished optical properties. Although including optical brightening agents (OBAs) in a papermaking process where bentonite is used can improve the brightness of the paper, often the improvement is insignificant and insufficient for most high quality papers, for instance highly bright paper with TAPPI brightness values in excess of 92, preferably 96 to 99 or higher. Thus in order to provide these highly bright papers swelling clay based retention systems are normally considered unsuitable and are thus avoided.

WO-A-98/23815 attempted to overcome this problem by combining an optical brightening agent with a slurry of anionic bridging coagulant, such as bentonite and then combining this into the paper making stock. Although significant improvements in paper brightness were achieved using this process, we have found that there is still a need to further enhance brightness, particularly base brightness.

Generally in order to provide paper of only moderate brightness when using clay based retention systems it would be necessary to use high levels of optical brightening agents (OBAs). However, in highly filled paper making processes we have found that the presence of high levels of Optical Brightening Agents can have a deleterious effect on filler retention.

Although various attempts have been made to improve the effectiveness of optical brightening agents, to date no-one has developed an effective optical brightening agent that can be used with swelling clay based retention systems.

Thus there is still a need for a method of improving the brightness of paper or paper-board when using a swelling clay (e.g. bentonite) based retention system. In particular there is a need to provide a method making paper which combines the benefits of high filler and fibre retention and fast drainage, for instance as found using swelling clay based retention systems, with providing paper with high overall brightness, especially employing reduced levels of optical brightening agents.

In addition there is also a need for providing filled paper with a high degree brightness and improving filler retention.

Thus according to the present invention we provide a process for making paper or paper board comprising, forming an aqueous cellulosic suspension, adding a retention system to the cellulosic suspension, draining the suspension on a screen to form a sheet and drying the sheet, characterised in that the retention system comprises a swelling clay which has a TAPPI brightness of at least 70.

Thus it has been found that the overall brightness of paper can be improved by employing swelling clays with a TAPPI brightness of at least 70. The swelling clay may be, for instance bentonites, sepiolites and attapulgites etc., provided that these clays exhibit a TAPPI brightness of at least 70. The bentonites include a general class of clays known as smectites, which include such clay varieties as montmorillonites, saponites, armargosite, nontronite and hectorite. Preferably the swelling clay is a bentonite.

The TAPPI brightness test is a standard test method for determining brightness, for example of pulp, paper and board, but may also be applied to swelling clays such as bentonite. Specific details of this method are given in for instance TAPPI published standard test method T 452 on-92 of 1992 entitled Brightness of pulp, paper and paperboard (directional reflectance at 457 nm).

It also has been found that swelling clays, for instance bentonites, which contain low or negligible levels of transition metal impurities tend to exhibit TAPPI brightness values of at least 70. In particular we find that the bright bentonites tend to contain below 1% transition metal impurities, which may be for instance iron oxides or other iron compounds. Conversely we find that bentonites that contain significantly greater than 1% by weight transition metals have brightness values of significantly below 70. This is particularly true of bentonites that contain up to 10% transition metal impurities, especially where the impurities include iron oxides or other iron compounds.

The swelling clay may be any number of commercially available clays, which exhibit a TAPPI brightness value of at least 70. The swelling clay may be for instance a sodium bentonite, comprising less than 1% transition metal compounds and exhibiting a TAPPI brightness value of 81, which is produced by the Waverly plant in Georgia, USA.

According to all aspects of the invention we further provide a process for making paper or paper board comprising, forming an aqueous cellulosic suspension, adding a retention system to the cellulosic suspension, draining the suspension on a screen to form a sheet and drying the sheet, characterised in that the retention system comprises a swelling clay that contains less than 1% by weight of one or more transition metal compounds.

According to both aspects of the invention the swelling clay may be used in combination with other retention aids as part of a multi-component retention system. Thus in one preferred system we provide a paper-making system which additionally comprises a polymeric retention aid. The polymeric retention system may be added to the cellulosic suspension simultaneously with the swelling clay, although, preferably the polymeric retention aid and swelling clay are added sequentially. In a preferred embodiment of this invention, the polymeric retention aid is added to the cellulosic suspension prior to the swelling clay. In a more preferred process the polymeric retention aid is added to the cellulosic suspension thereby flocculating cellulosic suspension, optionally shearing the suspension by passing the flocculated suspension through one or more shear stages, selected from pumping, mixing and cleaning stages and then subsequently the swelling clay is added in order to reflocculate the cellulosic suspension. For instance such shearing stages include fan pumps and centri-screens, but could be any other stage in the process where shearing of the suspension occurs.

The shearing step desirably acts upon the flocculated suspension in such a way as to degrade the flocs. All of the components of the flocculating system may be added prior to a shear stage although preferably at least the last component of the flocculating system is added to the cellulosic suspension at a point in the process where there is no substantial shearing before draining to form the sheet. Thus it is preferred that at least one component of the flocculating system is added to the cellulosic suspension and the flocculated suspension is then subjected to mechanical shear wherein the flocs are mechanically degraded and then at least one component of the flocculating system is added to reflocculate the suspension prior to draining.

The polymeric retention aid may be derived from any suitable natural or synthetic polymers. Desirably it may be selected from water soluble natural polymers and water soluble synthetic polymers of intrinsic viscosity of at least 1 dl/g. The polymeric retention aid may be for instance a water soluble starch, selected from cationic starch, amphoteric starch, anionic starch and nonionic starch. Preferably however, the polymeric retention aid is synthetic and comprises a high molecular weight polymer which is ionic in character. More preferably the water soluble cationic synthetic polymer formed from one or more ethylenically insaturated monomers and having intrinsic viscosity of at least 4 dl/g.

The water soluble synthetic polymer may be formed from water soluble ethylenically unsaturated monomers. By water soluble we mean that the monomer has a solubility in water of at least 5 g/100 cc. When the polymer is ionic it is formed from at least one water soluble ionic monomer. The water soluble polymer may be nonionic and thus formed from one or more nonionic monomers, for instance acrylamide, methacrylamide, 2-hydroxyethyl acrylate or N-vinylpyrrolidone. Water soluble anionic polymers may be formed from at least one anionic monomer for instance selected from acrylic acid, methacrylic acid or 2-acrylamido-2-methylpropane sulphonic acid. Desirably the water soluble polymeric retention aid is a cationic polymer which may be formed from a water soluble ethylenically unsaturated cationic monomer or blend of monomers wherein at least one of the monomers in the blend is cationic or potentially cationic. The cationic monomer is preferably selected from di allyl di alkyl ammonium chlorides, acid addition salts or quaternary ammonium salts of either dialkyl amino alkyl (meth) acrylate or dialkyl amino alkyl (meth) acrylamides. The cationic monomer may be polymerised alone or copolymerised with water soluble non-ionic, cationic or anionic monomers. Preferably such polymers have an intrinsic viscosity of at least 3 dl/g, for instance as high as 16 or 18 dl/g, but usually in the range 7 or 8 to 14 or 15 dl/g. Particularly preferred cationic polymers include copolymers of methyl chloride quaternary ammonium salts of dimethylaminoethyl acrylate or methacrylate.

The water soluble cationic polymer may also have a slightly branched structure for instance by incorporating small amounts of branching agent e.g. up to 20 ppm by weight. Typically the branching agent includes any of the branching agents defined herein suitable for preparing the branched anionic polymer. Such branched polymers may also be prepared by including a chain transfer agent into the monomer mix. The chain transfer may be included in an amount of at least 2 ppm by weight and may be included in an amount of up to 200 ppm by weight. Typically the amounts of chain transfer agent are in the range 10 to 50 ppm by weight. The chain transfer agent may be any suitable chemical substance, for instance sodium hypophosphite, 2-mercaptoethanol, malic acid or thioglycolic acid. Branched polymers comprising chain transfer agent may be prepared using higher levels of branching agent, for instance up to 100 or 200 ppm by weight, provided that the amounts of chain transfer agent used are sufficient to ensure that the polymer produced is water soluble. Typically the branched cationic water soluble polymer may be formed from a water soluble monomer blend comprising at least one cationic monomer, at least 10 molar ppm of a chain transfer agent and below 20 molar ppm of a branching agent. Preferably the branched water soluble cationic polymer has a rheological oscillation value of tan delta at 0.005 Hz of above 0.7 (defined by the method given herein). Typically the branched cationic polymers have an instrinsic viscosity of at least 3 dl/g, Typically the polymers may have an intrinsic viscosity in the range 4 or 5 up to 18 or 19 dl/g. Preferred polymers have an intrinsic viscosity of from 7 or 8 to about 12 or 13 dl/g.

The polymeric retention aid may also be an amphoteric polymer, in that it comprises both anionic and cationic groups. Thus the amphoteric polymer may be formed from at least one cationic monomer and at least one anionic monomer and optionally a nonionic monomer. Thus the amphoteric polymer may be derived from any of the aforementioned anionic, cationic and optionally nonionic monomers.

The water soluble polymeric retention aids may also be prepared by any convenient process, for instance by solution polymerisation, water-in-oil suspension polymerisation or by water-in-oil emulsion polymerisation. Solution polymerisation results in aqueous polymer gels which can be cut dried and ground to provide a powdered product. The polymers may be produced as beads by suspension polymerisation or as a water-in-oil emulsion or dispersion by water-in-oil emulsion polymerisation, for example according to a process defined by EP-A-150933, EP-A-102760 or EP-A-126528.

In a preferred process of making paper we provide a process in which a cationic polymer is added to the cellulosic suspension before the polymeric retention aid. In one process the cationic polymer, which is added before the polymeric retention aid is a low molecular weight cationic coagulant. Preferably, the cationic polymer is selected from the group consisting of polyDADMAC, polyimine, polyamine and dicyandiamide polymers.

The process for making paper may also include an optical brightening agent. The optical brightening agent may be included directly into the cellulosic suspension or alternatively with a component of the retention system, for instance the swelling clay or the polymeric retention aid.

The optical brightening agent may be applied to the surface of the formed paper sheet as a coating colour. For instance a coating colour composition comprises one or more filler or pigments, a fluorescent whitening agent (FWA), a binder, a rheology modification agent and optionally other chemical agents. The filler or pigment is usually a white inorganic particulate material and e.g. can be selected from the group consisting calcium carbonate, preferably of precipitated calcium carbonate or ground calcium carbonate, kaolin, titanium dioxide and talc. Usually the amount of filler or pigment is at least 75%, often at least 85% by weight, based on the coating colour composition.

Fluorescent whitening agents (FWA), also known as optical brightening agents (OBA), enhance the light reflectance qualities, and thus the brightness of the coated sheet. Binder is present to affix the pigment to the coated paper or board sheet and is normally an adhesive polymeric material, in the form of an aqueous latex. The rheology of the coating colour composition is normally adjusted to suit the specific application.

In the present invention the optical brightening agent (OBA) or fluorescent whitening agent (FWA) may be any chemical with the fluorescent ability to take in light from the ultraviolet part of the light spectrum and emit it in the visible spectrum. Preferably the fluorescent whitener is a stilbene fluorescent whitening agent, such as described in GB-A-2026566 and GB-A-2026054 or bis-stilbene fluorescent whitening agent, as described in EP-A-624687. The fluorescent whitening agent includes diaminostilbene disulfonic acid derivatives and tetraamino bis-stilbene disulfonic acid and derivatives, tetraamino bis-stilbene tetrasulfonic acid and derivatives and tetraamino bis-stilbene hexasulfonic acid and derivatives. Preferably the fluorescent whitening agents are provided in the form of an aqueous concentrated slurry, usually at least 30% by weight, for instance about 60% by weight.

A further embodiment of this invention concerns a paper and paperboard obtainable according to the inventive process.

A further embodiment of this invention concerns a composition comprising a swelling clay having a TAPPI brightness of at least 70 and a polymeric retention aid. The properties of this swelling clay and the retention aid are as described above.

A preferred embodiment of this composition concerns a composition, wherein the swelling clay is a bentonite.

A further embodiment of this invention concerns the use of a swelling clay having a TAPPI brightness of at least 70 for the manufacture of paper or paper board.

Another embodiment of this invention concerns the use of the above described composition for the manufacture of paper or paper board.

Another embodiment of this invention concerns a paper or paperboard comprising a swelling clay having a TAPPI brightness of at least 70.

A preferred embodiment of this invention relates to the above paper or paperboard, which further comprises a polymeric retention aid.

Another embodiment of this invention concerns a cellulosic suspension comprising a retention system comprising a swelling clay which has a TAPPI brightness of at least 70.

A preferred embodiment thereof relates to a cellulosic suspension further comprising a polymeric retention aid.

The following examples illustrate the invention.

EXAMPLE 1

A stock is prepared to a consistency (solids content) of 0.78% by weight, comprising 37.5% by weight hardwood, 37.5% by weight softwood and 25% by weight precipitated calcium carbonate. Into 500 ml aliquots of the stock a solution of a copolymer of acrylamide with methyl chloride quaternary ammonium salt of dimethylaminoethyl acrylate (75/25 wt./wt.) of intrinsic viscosity above 1 1.0 dl/g is added to each aliquot at 0.75 pounds per ton (375 ppm) and mixed for 10 seconds. Bentonite A is supplied by Waverly plant, Georgia, USA and has a brightness of 81 is added to the aliquots at a dose of 4 pounds per ton (2000 ppm). After 10 seconds of shear at 1000 rpm, the stock is poured into a handsheet mold. For each aliquot of stock the hand sheets are prepared in triplicate and brightness, fluorescence and opacity are measured. An average of two readings is made for each sheet. Sheet ash content is determined upon completion of the optical testing.

EXAMPLES 2 TO 4

Example 1 is repeated using Bentonite B, which is a commercially available bentonite, sourced from Texas, USA and exhibiting a brightness value of 56, Bentonite C which is a commercially available bentonite sourced from UK with a brightness value of 33 and polysilica microgel Particol™ BX (prepared according to Example 1 of WO-A-98/30753) at a dose of 1 pound per ton (500 ppm).

EXAMPLES 5 TO 20

Examples 1 to 4 are repeated except that prior to the addition of the acrylamide copolymer an optical brightening agent (OBA) Tinopal™ PT Liquid New is dosed into each aliquot at 10, 20, 30, 40 and 60 pounds per ton (5,000 ppm, 10,000 ppm, 15,000 ppm, 20,000 ppm and 30,000 ppm respectively) as received and stirred gently for 10 minutes before mixing at 1,000 rpm for 10 seconds.

The results of examples 1 to 20 are shown in Table 1

TABLE 1

| Example | OBA (pounds per ton) | Bentonite or silica microgel | Average Overall Brightness | Average Fluorescence | Average Base Sheet Brightness | Average Opacity | Average Sheet Ash content (%) |
|---|---|---|---|---|---|---|---|
| 1 | 0 | A | 92.6 | 0.0 | 92.6 | 90.9 | 23.4 |
| 2 | 0 | C | 91.6 | 0.0 | 91.6 | 90.1 | 23.2 |
| 3 | 0 | B | 92.0 | 0.0 | 92.0 | 91.2 | 23.1 |
| 4 | 0 | Particol BX | 92.5 | 0.0 | 92.5 | 90.1 | 23.0 |
| 5 | 10 | A | 96.1 | 3.8 | 92.3 | 90.4 | 21.5 |
| 6 | 10 | C | 95.6 | 3.8 | 91.8 | 90.1 | 20.8 |
| 7 | 10 | B | 96.4 | 3.8 | 92.5 | 90.1 | 21.3 |
| 8 | 10 | Particol BX | 96.6 | 3.9 | 92.7 | 90.1 | 21.1 |

TABLE 1-continued

| Example | OBA (pounds per ton) | Bentonite or silica microgel | Average Overall Brightness | Average Fluorescence | Average Base Sheet Brightness | Average Opacity | Average Sheet Ash content (%) |
|---|---|---|---|---|---|---|---|
| 9 | 20 | A | 97.8 | 5.2 | 92.6 | 89.6 | 19.8 |
| 10 | 20 | C | 97.0 | 5.3 | 91.7 | 89.5 | 18.9 |
| 11 | 20 | B | 97.3 | 5.2 | 92.1 | 89.6 | 19.0 |
| 12 | 20 | Particol BX | 98.1 | 5.6 | 92.5 | 88.6 | 18.5 |
| 13 | 30 | A | 98.3 | 6.1 | 92.2 | 88.8 | 18.3 |
| 14 | 30 | C | 97.2 | 6.0 | 91.2 | 89.3 | 17.5 |
| 15 | 30 | B | 97.9 | 6.1 | 91.8 | 88.2 | 17.4 |
| 16 | 30 | Particol BX | 98.2 | 6.2 | 92.1 | 89.1 | 17.0 |
| 17 | 40 | A | 98.7 | 6.6 | 92.1 | 88.2 | 16.9 |
| 18 | 40 | C | 97.8 | 6.5 | 91.3 | 87.5 | 16.1 |
| 19 | 40 | B | 98.2 | 6.6 | 91.6 | 87.7 | 16.0 |
| 20 | 40 | Particol BX | 98.7 | 7.0 | 91.7 | 87.3 | 15.5 |
| 21 | 60 | A | 98.7 | 7.4 | 91.3 | 86.8 | 15.0 |
| 22 | 60 | C | 98.6 | 7.5 | 91.1 | 86.6 | 13.9 |
| 23 | 60 | B | 98.7 | 7.4 | 91.4 | 85.9 | 13.8 |
| 24 | 60 | Particol BX | 99.0 | 7.8 | 91.2 | 85.5 | 12.5 |

Overall Brightness

Table 1 shows the overall brightness of the hand sheets made at each OBA level. The brightness of the sheets increases with the increasing addition of Tinopal™ PT Liquid New. Thus, it can clearly be seen that sheet brightness is improved by using a bentonite with higher sheet brightness. It can also be seen that less OBA is required when using bentonite A by comparison to the bentonites with lower brightness. In order to achieve a brightness of 98 points bentonite A only 20 pounds per ton of OBA are required whereas in order to achieve the same brightness with bentonite B and C 40 and 60 pounds per ton of OBA are required respectively.

Fluorescence

No significant difference in fluorescence is noted between each of the bentonites tested. This indicates that the contribution to the sheet by the OBA is similar in each case and so the overall brightness of the sheets varies on bentonite brightness (as deduced from Table 1). Slightly higher fluorescence values are obtained from sheets treated with the polysilica microgel Particol BX.

Base Brightness

Table 1 also illustrates the base brightness of the sheets, that is, the brightness not enhanced by OBA. The figure shows that base brightness decreases with increasing OBA dosage for each microparticle tested. This is attributed to the decrease in retention as anionicity increases with Tinopal dosage. First pass retention was not held constant in this study in order to examine the difference in brightness at common bentonite loadings. The decrease in retention lowered the PCC content of the sheets, which affects the base brightness of the sheet.

However, the base sheet brightness does indicate that bentonite brightness affects the sheet brightness. Table 1 shows also that Bentonite C sheets have less brightness than Bentonite B which is lower than Bentonite A. Using Bentonite A provides similar brightness to Particol BX.

Opacity

As mentioned with base sheet brightness, PCC content decreases as OBA dosage increases due to increased anionicity. This decrease in ash retention impacts on the opacity of the sheet as well as brightness. From Table 1 it is also clear that opacity decreases with increasing OBA dosage. No significant difference in opacity is noted between the microparticles.

Sheet Ash

Sheet ash is measured for each sheet prepared in the study. Table 1 shows that sheet ash decreases with increasing OBA dosage. This verifies the decrease in retention, base sheet brightness and opacity from higher Tinopal levels at sustained retention aid dosages. The figure also shows that more ash is retained in the sheet by Bentonite A than the other bentonites or Particol BX.

Thus in conclusion it can be seen that employing a bentonite with a brightness value of at least 70 improves the brightness of the paper sheets formed using other bentonites of lower brightness values.

Furthermore it can easily be seen that higher levels of OBA is required to achieve similar sheet brightness when using bentonites of lower brightness.

Equivalent overall brightness and higher ash retention can be achieved using a bentonite with a brightness value of at least 70. This means that for sheets with equivalent brightness a higher filler retention can be achieved using bentonite with a brightness value of at least 70.

The invention claimed is:

1. A process for making paper or paper board comprising, forming an aqueous cellulosic suspension, adding a retention system to the cellulosic suspension, draining the suspension on a screen to form a sheet and drying the sheet, characterised in that the retention system comprises a swelling clay wherein the swelling clay has a TAPPI brightness of at least 70 and the swelling clay contains below 1 weight % transition metal impurities and is selected from the group consisting of bentonite, smectites, montmorillonites, saponites, armargosite, nontronite, sepiolites and attapulgites with the proviso that hectorite is excluded.

2. A process according to claim 1 in which the swelling clay is bentonite.

3. A process according to claim 1 in which the retention system additionally comprises a polymeric retention aid.

4. A process according to claim 3, wherein the polymeric retention aid or the swelling clay is added to the cellulosic suspension after shear but prior to draining.

5. A process according to claim 1 in which an optical brightening agent for paper and paper board is added to the cellulosic suspension.

6. A process according to claim 1 in which the paper or paper board contains a filler.

7. A process according to claim 6 in which the filler is selected from the group consisting of precipitated calcium carbonate, ground calcium carbonate, kaolin, titanium dioxide and talc.

8. A composition comprising a swelling clay wherein the swelling clay has a TAPPI brightness of at least 70 and the swelling clay contains below 1 weight % transition metal impurities and is selected from the group consisting of bentonite, smectites, montmorillonites, saponites, armargosite, nontronite, sepiolites and attapulgites and a polymeric retention aid with the proviso that hectorite is excluded.

9. A composition according to claim 8, wherein the swelling clay is bentonite.

10. A composition according to claim 8 further comprising a fluorescent whitening agent or an optical brightening agent.

11. Paper or paperboard comprising a swelling clay wherein the swelling clay has a TAPPI brightness of at least 70 and the swelling clay contains below 1 weight % transition metal impurities and the swelling clay is selected from the group consisting of bentonite, smectites, montmorillonites, saponites, armargosite, nontronite, sepiolites and attapulgites with the proviso that hectorite is excluded.

12. Paper or paperboard according to claim 11 further comprising a polymeric retention aid.

13. The paper or paperboard according to claim 11 wherein the swelling clay is bentonite.

14. A paper or paperboard according to claim 11 wherein the swelling clay is bentonite and the paper or paperboard has a TAPPI brightness in excess of 92.

15. A paper or paperboard according to claim 14 further containing a fluorescent whitening agent or optical brightening agent and the paper or paperboard has a TAPPI brightness of 96 to 99 or higher.

16. A composition according to claim 11 further comprising a filler and the filler is selected from the group consisting of precipitated calcium carbonate, ground calcium carbonate, kaolin, titanium dioxide and talc.

17. A cellulosic suspension comprising a retention system comprising a swelling clay wherein the swelling clay has a TAPPI brightness of at least 70 and the swelling clay contains below 1 weight % transition metal impurities and the swelling clay is selected from the group consisting of of bentonite, smectites, montmorillonites, saponites, armargosite, nontronite, sepiolites, and attapulgites with the proviso that hectorite is excluded.

18. A cellulosic suspension according to claim 17 further comprising a polymeric retention aid.

* * * * *